US007651344B2

(12) United States Patent
Wu

(10) Patent No.: US 7,651,344 B2
(45) Date of Patent: Jan. 26, 2010

(54) POWER CONNECTOR CARRYING LARGER CURRENT

(75) Inventor: Jian-Feng Wu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,938

(22) Filed: Nov. 26, 2007

(65) Prior Publication Data

US 2008/0124956 A1 May 29, 2008

(30) Foreign Application Priority Data

Nov. 24, 2006 (CN) ..... 200610097744.5

(51) Int. Cl.
*H01R 12/30* (2006.01)

(52) U.S. Cl. ..... 439/80; 439/910; 439/626

(58) Field of Classification Search ..... 439/910, 439/80, 63, 79

See application file for complete search history.

(56) References Cited

U.S. PATENT DOCUMENTS 4,593,464 A * 6/1986 Williams et al. ..... 439/675
4,983,127 A * 1/1991 Kawai et al. ..... 439/79
5,334,346 A * 8/1994 Kim et al. ..... 420/485
6,623,277 B1 * 9/2003 Zhu et al. ..... 439/63
6,695,644 B2 2/2004 Zhao et al.
7,335,062 B1 * 2/2008 Ju ..... 439/607

FOREIGN PATENT DOCUMENTS

CN 2548282 4/2003

* cited by examiner

*Primary Examiner*—Briggitte R Hammond
(74) *Attorney, Agent, or Firm*—Andrew C. Cheng; Wei Te Chung; Ming Chieh Chang

(57) ABSTRACT

A power connector comprises an insulative housing (1), a first and a second conductive terminals (3, 4) arranged in the housing, each terminal comprising a main body (31, 41), a plurality of resilient contact arms (32, 42) extending forwardly from the main body. The resilient contact arms (32, 42) of the first and the second conductive terminals respectively form an outer circle and an inner circle, and the conductive terminals (3, 4) are made of metal plate with electrical conductivity higher than 30% IACS.

18 Claims, 7 Drawing Sheets

3

POWER CONNECTOR CARRYING LARGER CURRENT

BACKGROUND OF THE INVENTION

1. Field of the Invention

The present invention relates to a power connector, which can carry a larger current.

2. Description of Related Art

Power connectors are widely used in the field of electronic products to supply power, especially in the portable devices such as laptop computer and PDA. With the function diversification of those devices, demand for power connector with high performance of carrying large current is required.

U.S. Pat. No. 6,695,644 discloses a power connector, which includes an insulative housing, a first and a second conductive contacts retained in the insulative housing and a shield surrounding the insulative housing. The first conductive contact has four symmetrically arranged resilient arms forming an outer circle, and the second conductive contact has four corresponding resilient arms forming an inner circle. In common use, the power connector disclosed above might not meet the larger current demand.

Furthermore, contacts of power connectors are made of phosphor-copper currently. Temperature of said contacts will increase rapidly, when the current the connector transmitted beams larger, which may be harmful to the power connectors and the portable device. Therefore, a new design which can overcome the limitation is required.

SUMMARY OF THE INVENTION

An object of the present invention is to provide a power connector carrying a larger current.

In order to achieve above-mentioned objects, a power connector comprises an insulative housing, a first and a second conductive terminals arranged in the housing. Each terminal comprises a main body, a plurality of resilient contact arms extending forwardly from the main body. The resilient contact arms of the first and the second conductive terminals respectively form an outer circle and an inner circle, and the conductive terminals are made of metal plate with electrical conductivity higher than 30% IACS.

Other objects, advantages and novel features of the present invention will become more apparent from the following detailed description of the present embodiment when taken in conjunction with the accompanying drawings.

DETAILED DESCRIPTION OF THE INVENTION

Figure 1:
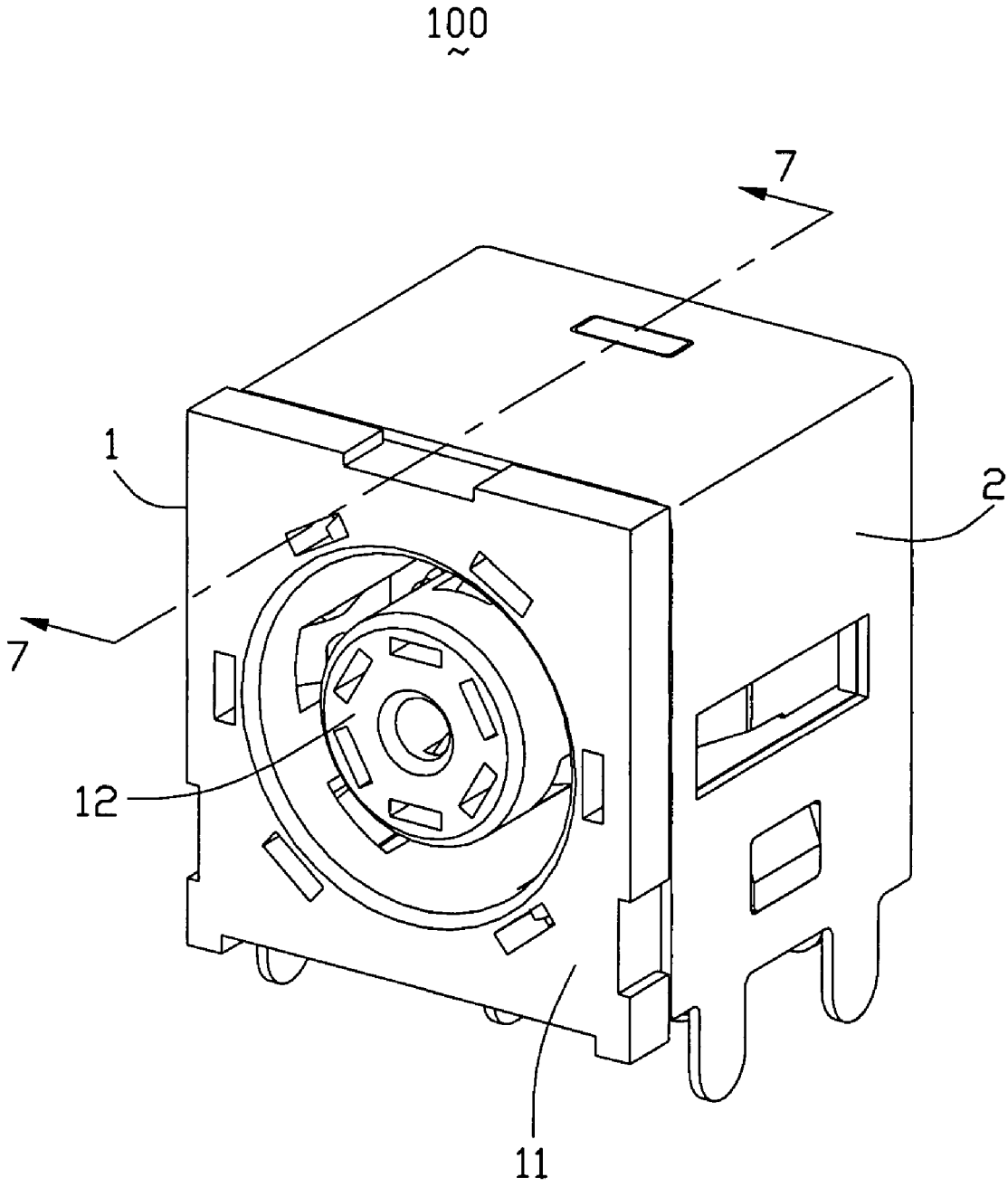
FIG. 1 is a front, left perspective view of a power connector in accordance present invention.

Reference will now be made to the drawing figures to describe the preferred embodiment of the present invention in detail.

Figure 2:
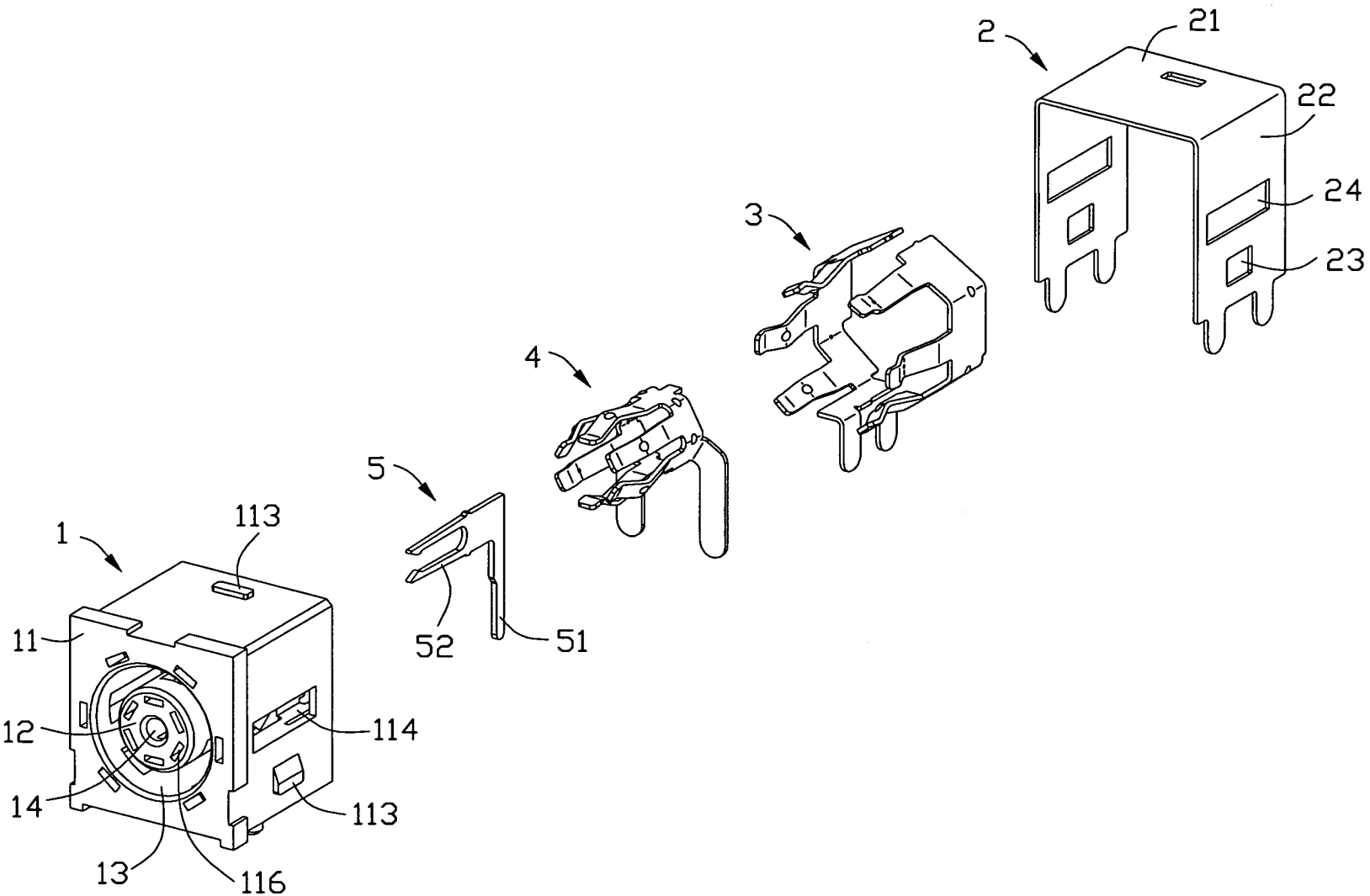
FIG. 2 is an exploded perspective view of the power connector shown in FIG. 1.

Referring to FIGS. 1 and 2, a power connector comprises an insulative housing 1, a shield 2, a first and a second conductive terminals 3, 4, and a signal contact 5.

Figure 3:
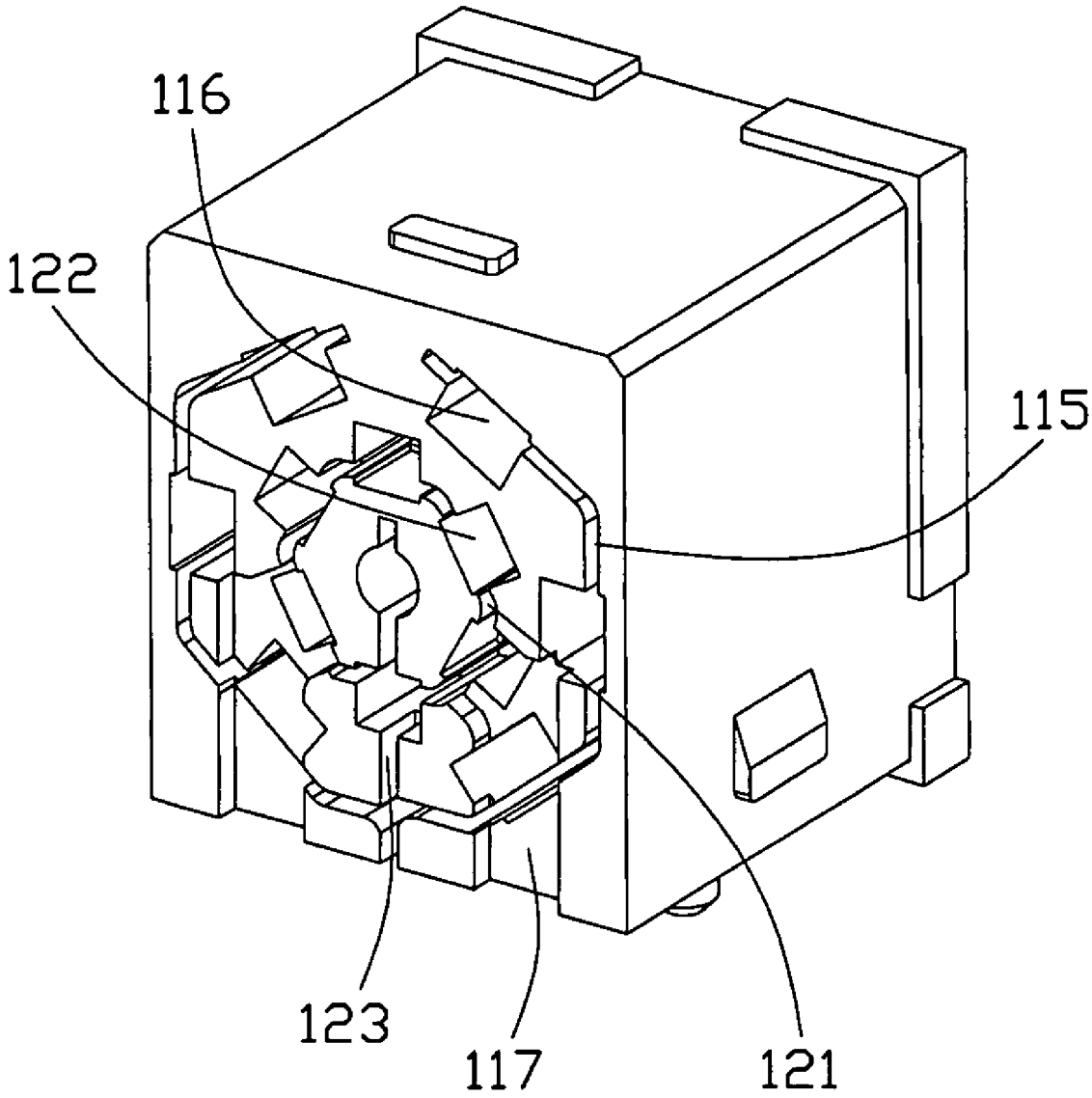
FIG. 3 is a back, left perspective view of an insulative housing.

The insulative housing 1 comprises a first housing 11 in shape of a rectangular block, a receiving cavity 13 defined rearwardly from a front face (not figured) of the first housing and a cylindrical second housing 12, extending forwardly from a rear wall of the housing. A central hole 14 is defined along a longitudinal axis of the second housing 12. As shown in FIG. 3, a first receiving slot 115 and a second receiving slot 121 in shape of hexagon are defined in the rear wall of the housing. The first receiving slot 115 is an outer hexagon and the second receiving slot 121 is an inner hexagon. Six first passages 116 are defined at one side of the outer hexagon, and extend forwardly through the front surface of the first housing 11 and communicate with the receiving cavity 13 in its middle portion. Six second passages 122 are defined at one side of the inner hexagon, and extend forwardly through the front surface of the second housing 12 and communicate with the receiving cavity 13 in its middle portion. At the bottom wall, a narrow channel 123 extends downwards through the bottom of the housing from one of the second passages 121 and two boarder channels 117 parallel to the narrow channel 123 are defined at sides of the narrow channel.

Figure 4:
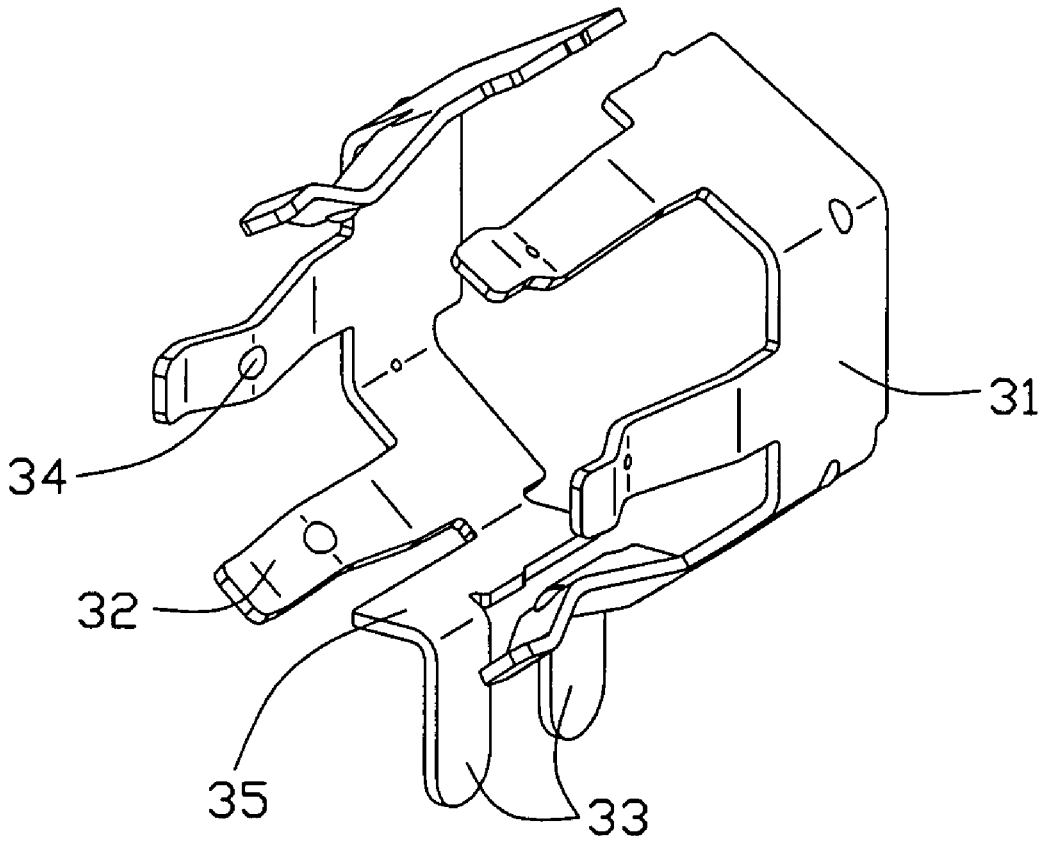
FIG. 4 is a perspective view of a first conductive terminal.

Referring to FIG. 4, the first conductive terminal 3 is made of a pair of nickel-copper plate, which comprises a main body 31, six resilient contact arms 32 and two solder tails 33. The pair of metal plates is bended symmetrically to form a hexagon-ring main body 31, each plate being three portions. Six first resilient contact arms 32 with dimples 34 at contacting points are on the hexagon main body 31 together, and each arm extends forwardly and inwardly from side edge of each portion of the metal plate. At bottom end of the right half of main body 31, one solder tail 33 extends downwardly, and at bottom end of the left half of the main body 31, another solder tail 33 extends downwardly from a supporting portion 35 connecting the end of the main body 31 and the solder tail 33, so the two solder tails are arranged in a front-to-back direction.

Figure 5:
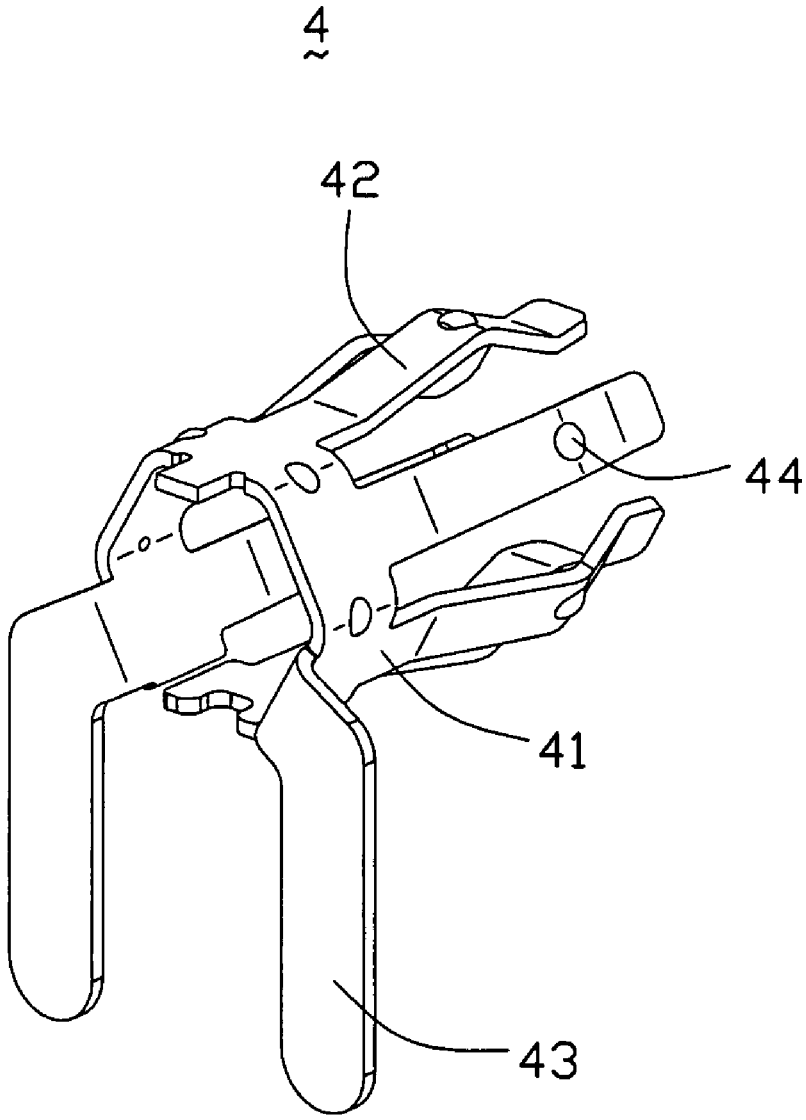
FIG. 5 is a perspective view of a second conductive terminal.

Referring to FIG. 5, the second conductive terminal 4 is also made of one nickel-copper plate, and the structure is similar to the first conductive terminal 3. The terminal 4 comprises a hexagon main body 41, six second resilient contact arms 42 arranged in equal intervals at the front side edges of the main body 41, and two solder tails 43 arranged separately and extending downwardly from the back side edge of the main body 41. The second resilient contact arm 42 extends forwardly and outwardly with several dimples 44 at contacting points. The first conductive terminal 3 acts as a positive contact, while the second conductive terminal 4 acts as a negative contact for the power connector.

Figure 6:
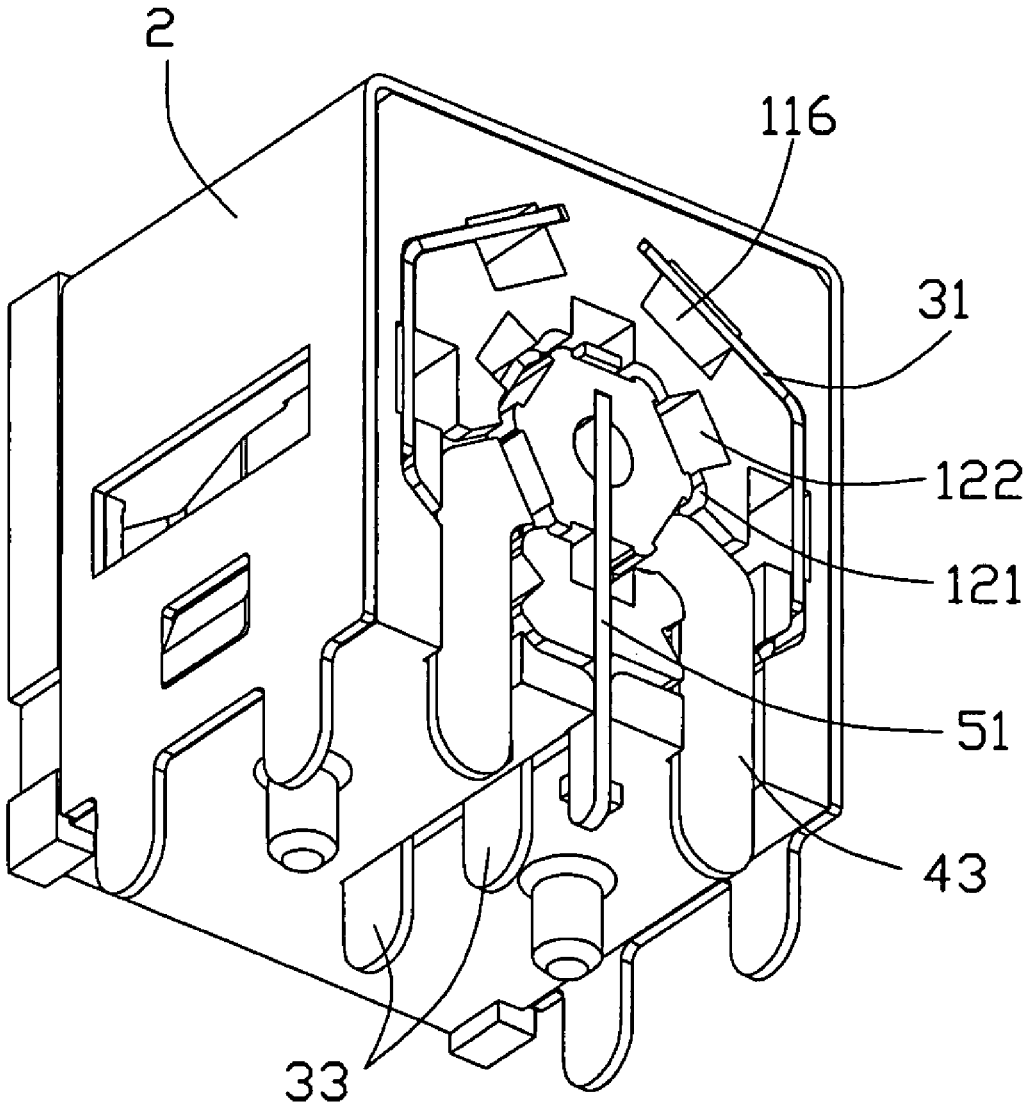
FIG. 6 is a back, right perspective view of the power connector.
Figure 7:
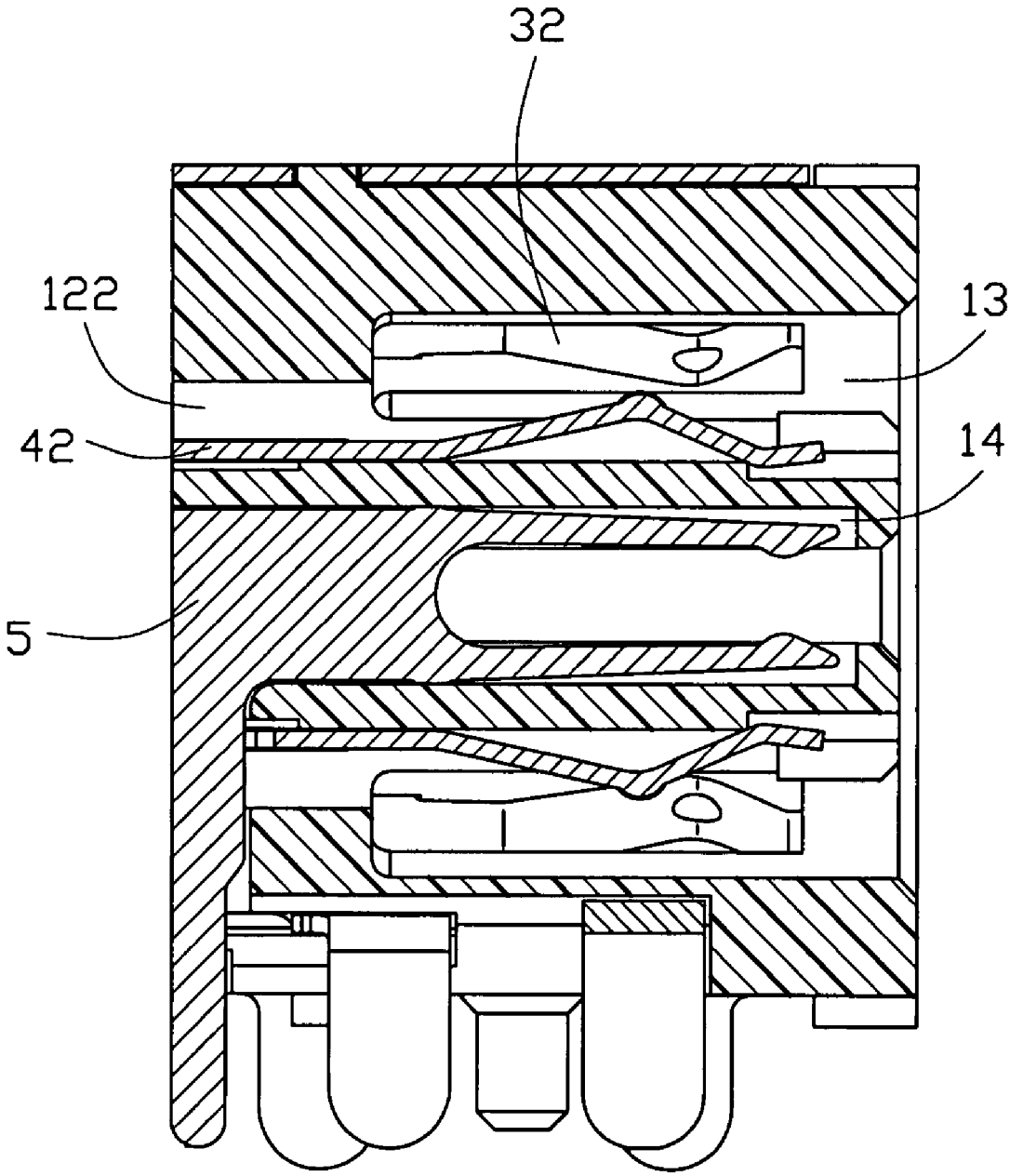
FIG. 7 is a cross-sectional view of the power connector taken along line 7-7 of FIG. 1.

Now referring to FIGS. 6 and 7, the first and second conductive terminals 3, 4 are assembled into the housing from the rear wall of the housing thereof, with the main bodies 31, 41 retained in the first and second receiving slots 115, 121. The first and second resilient arms 32, 42 are received in the first and second passages 116, 122 and partly protruding to the receiving cavity 13, as best shown in FIG. 7. There is a receiving space (not figured) between the first and the second resilient arms 32, 42 for contacting with a counter connector (not shown). The dimples 34, 44 are facing the receiving space and actually increase engagement between the resilient arms and the counter connector. The solder tails 33, 43 of the first and second conductive terminals 3, 4 are respectively received in the boarder channels 117 and the narrow channel 123.

Referring to FIGS. 2 and 6, The signal contact 5 is retained in the housing 1 with a tuning-fork shape mating portion 52 received in the central hole 14 and a solder leg 51 extends downwardly in the narrow channel 123. The housing defines protrusions 113 respectively on the top wall and two side walls, and a pair of rectangle windows 114 at the two side walls for extracting heat and communicating with the receiving cavity 13. The shield 6 in shape of "n" is assembled on the insulative housing 1 and comprises a top wall 21 and a pair of side walls 22. Three locking holes 23 are formed on each wall and being locked by the protrusions 113 on the housing. A pair of heat extracting holes 24 are formed in the center of the side walls 22 and communicating with windows 114 on the housing. Therefore, a power connector is assembled, as best shown in FIG. 6.

In the present invention, both of the first and the second terminals 3, 4 can alternatively select resilient contact arms from five to eight (six resilient contact arms in this embodiment), which form a parallel circuitry thereby resulting in reduction of electrical resistance. Besides, the dimples 34, 44 on the resilient contact arms 32, 42 can distribute the current and reduce the electrical resistance. Furthermore, the terminals of the power connector in accordance with the present invention are made of nickel-copper instead of phosphor-copper (which is used currently). The electrical conductivity of nickel-copper is 40% IACS (International Annealed Copper Standard), but the electrical conductivity of phosphor-copper is only 14% IACS. In the same circumstance, two similar connectors respectively made of nickel-copper and phosphor-copper carry the same current in fixed time, the temperature of the nickel-copper terminal is rising less than the temperature of the phosphor-copper terminal, which completely meets the demand of carrying larger current. Anyway, the material having electrical conductivity higher than 30% is also adoptable to make the terminals.

The present invention is not limited to the electrical connector mentioned above. This disclosure is illustrative only, changes may be made in detail, especially in matter of shapes, size, and arrangement of parts within the principles of the invention.

What is claimed is:

1. A power connector comprising:

an insulative housing with a first and a second conductive terminals secured therein;

each terminal comprising a main body and a plurality of resilient contact arms extending forwardly from the main body, the resilient contact arms of the first and the second conductive terminals respectively defining an outer circle and an inner circle;

wherein said conductive terminals are made of metal plate with electrical conductivity higher than 30% IACS;

wherein a receiving space is formed between the first and second conductive terminals, and said insulative housing defining windows communicating with the receiving space.

2. The power connector as described in claim 1, wherein the insulative housing comprises a second housing and said receiving space is defined between the insulative housing and the second housing, said first conductive terminal is retained in the housing outer the receiving space, and said second conductive terminal is retained in the second housing inner the receiving space.

3. The power connector as described in claim 1, wherein each conductive terminal can alternatively have five to eight resilient contact aims.

4. The power connector as described in claim 3, wherein each conductive terminal has six resilient contact arms.

5. The power connector as described in claim 4, wherein the first conductive terminal is made of a pair of nickel-copper plates, and the pair of plates are bended to form the main body and said six resilient contact arms respectively extending from side edges of the main body.

6. An electrical connector for power supply comprising:

an insulative housing defining a receiving cavity therein;

a first set of contacts arranged along a half of a circle area;

a second set of contacts arranged along the other half of said circle area;

rear ends of said first set of contacts unified by a first main body; and rear ends of said second set of contacts unified by a second main body;

wherein said first and second main bodies are separately formed and leave a pair of boundaries therebetween, said main bodies being respectively equipped with corresponding tails for mounting to a printed circuit board under a condition that said tails extend downward from one boundary;

wherein at least one window is defined on periphery of the housing and communicates with the receiving space for heat elimination during power supply.

7. The electrical connector as described in claim 6, wherein both said tails are aligned with each other in a front-to-back direction.

8. The electrical connector as described in claim 7, further comprising a third set of contacts located inner said circle area, and unified by another main body which is configured in a polygonal shape, wherein said first and second main bodies commonly form the same polygonal shape.

9. The electrical connector as described in claim 8, wherein the third set of contacts act as one polarity of the electrical connector, and the first and second set of contacts commonly act as the opposite polarity of the electrical connector.

10. The electrical connector as described in claim 6, further including a third set of contacts essentially equidistantly arranged in another frill circle area which is smaller than said circle area, wherein said third set of contacts is unified via another main body.

11. The electrical connector as described in claim 10, wherein said another main body is equipped with a pair of tail sections lying in a transverse direction perpendicular to the front-to-back direction for mounting to said printed circuit board.

12. The electrical connector as described in claim 11, wherein said another main body is configured with a hexagonal shape to comply with an amount of said third set of contacts so as to form a dense arrangement of said third set of contacts.

13. An electrical connector comprising:

an insulative housing including a plurality of inner passageways commonly defining an inner ring region, and a plurality of outer passageways commonly defining an outer ring region;

a plurality of first contacting sections disposed in the corresponding inner passageways, respectively;

a plurality of second contacting sections disposed in the corresponding outer passageways, respectively;

said inner passageways being arranged with equal intervals along a circumference of said inner region under a condition that every adjacent two first contacting sections are dimensioned and spaced from each other with a first gap between tip sections of the adjacent first contacting sections which is smaller than a width of said tip section of said first contacting section and rear ends of said first contacting sections are unified together via a first main body so as to achieve the maximum use of available space in the housing;

wherein at least one window is defined on periphery of the housing and communicates with the receiving space for heat elimination during power supply.

14. The electrical connector as claimed in claim 13, wherein the second contacting sections and the first contacting sections are staggered with each other circumferentially.

15. The electrical connector as claimed in claim 14, wherein every adjacent two second contacting sections in dimensioned and spaced from each other with a second gap between tip sections of the adjacent two second contacting sections which is larger than a width of said tip section of said second contacting section.

16. The electrical connector as claimed in claim 14, wherein rear ends of said second contacting sections are unified as two groups by two second main bodies, respectively.

17. The electrical connector as claimed in claim 16, wherein said second main bodies are further respectively equipped with two corresponding tails for mounting to a printed circuit board, and said two tails are aligned with each other along a front-to-rear direction.

18. The electrical connector as claimed in claim 17, wherein the first main body is further equipped with two tail sections aligned with each other in a transverse direction perpendicular to said front-to-back direction.

* * * * *